US007533664B2

(12) United States Patent
Carnall

(10) Patent No.: US 7,533,664 B2
(45) Date of Patent: May 19, 2009

(54) PAINTBALL GUN ASSEMBLY

(75) Inventor: Martin Carnall, Barwell (GB)

(73) Assignee: Black Market Sportz Limited, Nuneaton, Warwickshire (GB)

( * ) Notice: Subject to any disclaimer, the term of this patent is extended or adjusted under 35 U.S.C. 154(b) by 386 days.

(21) Appl. No.: 11/113,641

(22) Filed: Apr. 25, 2005

(65) Prior Publication Data

US 2005/0235976 A1 Oct. 27, 2005

(30) Foreign Application Priority Data

Apr. 26, 2004 (GB) ..... 0409179.9

(51) Int. Cl.
*F41B 11/32* (2006.01)

(52) U.S. Cl. ..... 124/77

(58) Field of Classification Search ..... 124/71–77; 137/625.68

See application file for complete search history.

(56) References Cited

U.S. PATENT DOCUMENTS

| | | | | | |
|---|---|---|---|---|---|
| 2,526,361 | A | * | 10/1950 | Johnson | 137/625.66 |
| 2,648,313 | A | * | 8/1953 | Clifton | 137/625.68 |
| 2,836,154 | A | * | 5/1958 | Lantz | 137/625.62 |
| 2,881,752 | A | | 4/1959 | Blahnik | 124/11 |
| 3,262,636 | A | | 7/1966 | Palfreyman | 230/132 |
| 3,596,560 | A | * | 8/1971 | Butterworth | 91/6 |
| 3,990,477 | A | * | 11/1976 | Johnson | 137/625.69 |
| 5,503,137 | A | * | 4/1996 | Fusco | 124/72 |
| 5,613,483 | A | * | 3/1997 | Lukas et al. | 124/73 |
| 5,722,373 | A | * | 3/1998 | Paul et al. | 123/446 |
| 6,003,504 | A | * | 12/1999 | Rice et al. | 124/73 |
| 6,138,656 | A | * | 10/2000 | Rice et al. | 124/73 |
| 6,820,606 | B1 | * | 11/2004 | Duffey | 124/31 |
| 2003/0047174 | A1 | * | 3/2003 | Tiberius et al. | 124/74 |
| 2003/0079731 | A1 | * | 5/2003 | Dobbins | 124/76 |
| 2005/0126553 | A1 | * | 6/2005 | Rice | 124/31 |
| 2005/0145235 | A1 | * | 7/2005 | Jong | 124/73 |
| 2006/0037597 | A1 | * | 2/2006 | Wood | 124/73 |
| 2006/0162712 | A1 | * | 7/2006 | Yeh | 124/73 |
| 2006/0185657 | A1 | * | 8/2006 | Gabrel | 124/73 |
| 2007/0028909 | A1 | * | 2/2007 | Wood | 124/73 |

FOREIGN PATENT DOCUMENTS

| | | | |
|---|---|---|---|
| EP | 0105895 | A | 4/1984 |
| GB | 902640 | A | 8/1962 |
| GB | 21292528 | A | 5/1984 |

* cited by examiner

*Primary Examiner*—Troy Chambers
(74) *Attorney, Agent, or Firm*—Caesar, Rivise, Bernstein, Cohen & Pokotilow, Ltd.

(57) ABSTRACT

A paintball gun assembly comprises a casing having a barrel and a bolt moveable in the barrel to select and fire paintballs. There are located in the casing under the barrel in a linear array generally parallel with the barrel a low pressure regulator, a chamber for air under pressure, a spool valve, a poppet valve, a solenoid and a battery. The spool valve comprises an elongated housing of circular section in which a spool is reciprocable to move seals on the spool relative to radial openings of the housing. The valve has an input opening at one end of the spool and the spool has a longitudinal bore to communicate said input opening with the periphery of the spool at a position between an adjacent pair of said seals.

10 Claims, 2 Drawing Sheets

18

18

PAINTBALL GUN ASSEMBLY

This Application is related to and claims priority from British Patent Application No. GB 0409179.9 filed Apr. 26, 2004.

This invention relates to a paintball gun assembly including a pneumatic spool valve for controlling movement of the bolt of a paintball gun.

BACKGROUND OF THE INVENTION

A paintball gun has a bolt which, by moving forward, selects a paintball from a magazine and then admits air under pressure to the barrel of the gun behind the selected paintball to fire it. After the selected paintball has been fired the bolt has to be moved back. Paintball guns therefore have pneumatic spool valves which have ports selectively communicable with air chambers in front of and behind the bolt. To move the bolt forward an air chamber behind the bolt is communicated with the same source of compressed air as is used to fire a paintball while at the same time an air chamber in front of the bolt is vented. To move the bolt back the chamber in front of the bolt is pressurised while the chamber behind the bolt is vented.

The spool valves currently used in paintball guns have air admission and discharge ports which are radial with respect to the spool of the valve. Consequently there must be associated with the spool valve a manifold having air passageways generally parallel with the spool of the valve. The spool valve is located in a square-section housing which also accommodates a poppet valve which actuates the spool valve and a solenoid which actuates the poppet valve. The manifold is adjacent one side of the housing. This assembly is of substantial vertical extent, making the gun as a whole tall and ungainly.

A principal object of the present invention is to provide a slimmer and more compact paintball gun.

SUMMARY OF THE INVENTION

The invention provides paintball gun assembly comprising a casing having a barrel and a bolt moveable in the barrel to select and fire paintballs, wherein there are located in the casing under the barrel in a linear array generally parallel with the barrel a low pressure regulator, a chamber for air under pressure, a spool valve, a poppet valve, a solenoid and a battery, the spool valve comprising an elongated housing of circular section in which a spool is reciprocable to move seals on the spool relative to radial openings of the housing, the valve having an input opening at one end of the spool, the spool having a longitudinal bore to communicate said input opening with the periphery of the spool at a position between an adjacent pair of said seals.

Preferably the housing has four radial openings spaced longitudinally of the housing and the spool has four seals spaced longitudinally of the spool, each said seal comprising an O-ring in a respective circumferential groove in the periphery of a portion of the spool which is a sliding fit within the housing.

Preferably the longitudinal bore in the spool communicates with the spool periphery between the inner pair of seals.

Preferably said chamber for air under pressure is located at one end of the valve to communicate with said input opening, means for actuating the valve being provided at its other end.

Said means for actuating the spool valve preferably comprises said poppet valve in turn actuated by said solenoid.

BRIEF DESCRIPTION OF THE DRAWINGS

A preferred embodiment of the invention will now be described by way of non-limitative example with reference to the accompanying drawings, in which.

DETAILED DESCRIPTION OF A PREFERRED EMBODIMENT

Figure 1:
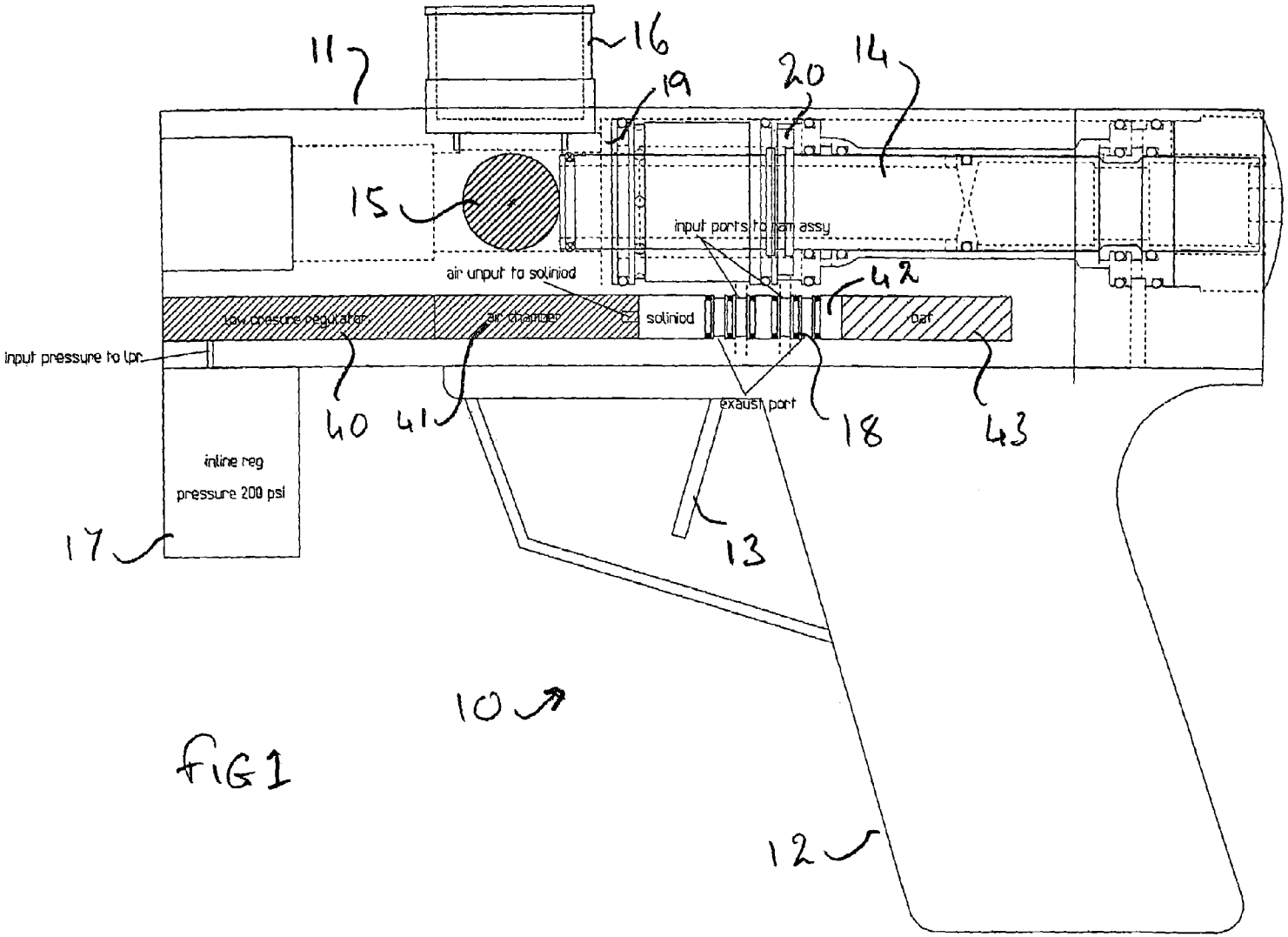
FIG. 1 is a sectional view of a paintball gun.

The paintball gun 10 of FIG. 1 has a barrel 11, a grip 12 and a trigger 13. Within the barrel 11 a bolt 14 is slideable between the retracted position in which it is shown and a forward, firing position when the trigger 13 is pulled. In moving forward the bolt 14 selects a paintball 15 from a magazine 16 above the barrel 11 and moves it to a position where compressed air from a canister 17 is admitted to the barrel behind the paintball to fire the latter. A spool valve 18 controlled by the trigger 13 admits compressed air from the canister 17 alternatively to air chambers 19 and 20 in front of and behind seals on the bolt 14 to move the latter between its firing and retracted positions. As so far described the paintball gun 10 is conventional so that further explanation is unnecessary.

Figure 2:
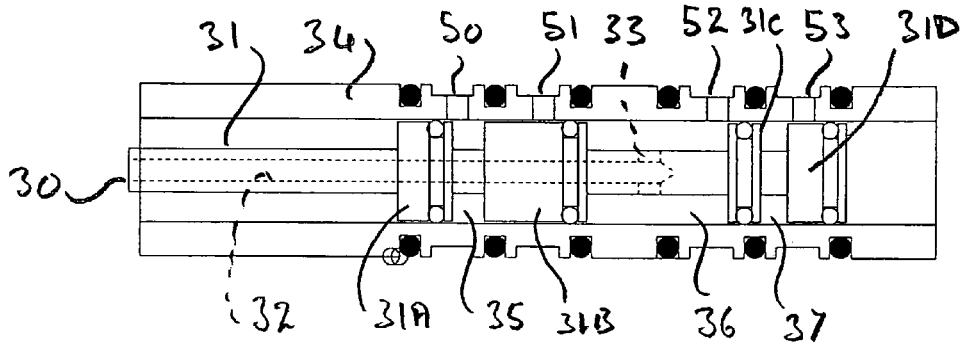
FIG. 2 is a view on a larger scale of the spool valve of the gun of FIG. 1.
Figure 3:
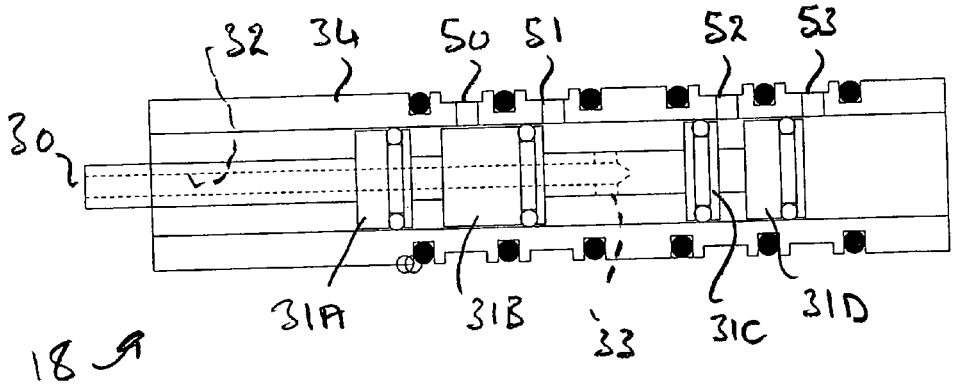
FIG. 3 is a view similar to FIG. 2 but showing the spool valve in the bolt-retracting position.

In accordance with the present invention, however, the spool valve 18 is as illustrated in FIGS. 2 and 3 and has an air input port 30 at one end of the spool 31. This opens to a longitudinal bore 32 in the spool which, at its blind end, has radial openings 33 to the periphery of the spool. As is known per se the spool 31 has axially separated enlargements 31A, 31B, 31C and 31D each of which is a sliding fit within the circular-section, tubular housing 34 of the spool valve. Each enlargement has a circumferential groove in which a respective O-ring seal is located. Thus the seals provide three mutually isolated air chambers 35, 36 and 37 spaced along the length of the spool 31 and it will be noted that the openings 33 are to the middle chamber 36 between the inner pair of seals.

It will be noted from FIG. 1 that the spool valve 18 is part of a linear array generally parallel with the axis of the barrel 11 of the gun. The other elements of the array are, in sequence, a low pressure regulator 40 receiving compressed air from the canister 17, an air chamber 41 receiving air from the regulator 40, the spool valve 18 and means 42 for actuating the spool valve. The spool valve actuating means 42 may be a poppet valve (not shown) in turn actuated by a solenoid (not shown), a battery 43 being provided for energising the solenoid.

Thus the spool valve 18 receives compressed air from a chamber 41 at one of its ends, means 42 for actuating the spool valve being provided at its other end. This linear arrangement occupies relatively little space measured vertically, allowing the gun to have a lower, more realistic profile and making it less cumbersome and unwieldy than known paintball guns.

The housing 34 of the spool valve has four radial openings 50, 51, 52 and 53. The inner pair of openings 51 and 52 are for supplying compressed air respectively to the chambers 19 and 20 of the bolt 14 while the outer pair of openings 50 and 53 are for venting air respectively from the chambers 19 and 20. With the spool valve as shown in FIG. 2 the opening 52 is in communication with the bore 32 in the spool so that compressed air is being supplied to the chamber 20. Simultaneously the chamber 19 is being vented through the opening 50. The openings 51 and 53 are closed off. When the spool 31 is moved to the position of FIG. 3 the opening 51 communicates with the bore 32 so that compressed air is being supplied to the chamber 19. Simultaneously the chamber 20 is being vented through the opening 53. The openings 50 and 52 are closed off.

When the trigger 13 is pulled the solenoid is energised causing the spool 31 to move to the position of FIG. 1. Compressed air is applied to the chamber 20 and vented from the chamber 19, causing the bolt 14 to move forward. This displaces the paintball 15 to a position in which it can be fired from the barrel 11. When the trigger 13 is released the spool 31 is returned to the position of FIG. 3. The chamber 19 is pressurised and the chamber 20 vented and the bolt 14 is retracted to the position in which it is shown in FIG. 1.

I claim:

1. A paintball gun assembly comprising a casing, a low pressure regulator for receiving compressed air from a source, a chamber for receiving air under pressure from the regulator, a spool valve, and an actuator means for actuating the spool valve, the casing having a barrel and a bolt moveable in the barrel to select and fire paintballs, the spool valve comprising an elongated housing of circular section in which a spool is reciprocable, the housing including radial openings therein, the spool including two seals associated therewith and a longitudinal bore therein, the longitudinal bore including an inlet at one end of the spool and an outlet between the two seals for selectively communicating the chamber with the radial openings in the housing for controlling movement of the bolt, wherein the regulator, the chamber, the spool valve and the actuator are located in the casing under the barrel and arranged in an approximately linear array generally parallel with the barrel.

2. A paintball gun assembly as claimed in claim 1, wherein the housing has four radial openings spaced longitudinally of the housing and the spool has four seals spaced longitudinally of the spool, each said seals comprising an o-ring in a respective circumferential groove in a periphery of a portion of the spool which is a sliding fit within the housing.

3. A paintball gun assembly as claimed in claim 2, wherein the outlet is between an inner pair of said four seals spaced longitudinally of the spool.

4. A paintball gun assembly as claimed in claim 1, wherein said chamber for air under pressure is located at one end of the spool valve adjacent the inlet to communicate with said inlet, the actuator means being provided at its other end.

5. A paintball gun assembly as claimed in claim 1, wherein said actuator means for actuating the spool valve comprises a poppet valve which is actuated by a solenoid.

6. A paintball gun assembly as claimed in claim 5, wherein said means for actuating the spool valve further comprises a battery for energizing the solenoid.

7. A paintball gun assembly as claimed in claim 1, further comprising a second air chamber in front of seals on the bolt and a third air chamber behind seals on the bolt.

8. A paintball gun assembly as claimed in claim 7, wherein a first of the radial openings in the housing communicates with the second air chamber and a second of the radial openings in the housing communicates with the third air chamber.

9. A paintball gun assembly as claimed in claim 3, further comprising a second air chamber in front of seals on the bolt in communication with a first of the radial openings in the housing and a third air chamber behind seals on the bolt in communication with a second of the radial openings in the housing, wherein the outlet selectively communicates with the first and second radial openings.

10. A paintball gun assembly as claimed in claim 9, wherein a third of the radial openings in the housing communicates with the second air chamber and a fourth of the radial openings in the housing communicates with the third air chamber, the third and fourth radial openings being arranged to vent air respectively from the second and third air chambers.

* * * * *